United States Patent [19]

Thomas

[11] 4,127,930

[45] Dec. 5, 1978

[54] COATING WITH ANTIFRICTION METAL

[75] Inventor: John C. Thomas, Chester-le-Street, England

[73] Assignee: Vickers Limited, London, England

[21] Appl. No.: 732,768

[22] Filed: Oct. 15, 1976

[30] Foreign Application Priority Data

Oct. 16, 1975 [GB] United Kingdom ..... 42572/75

[51] Int. Cl.[2] ..... B22D 31/00

[52] U.S. Cl. ..... 29/527.6; 29/149.5 S

[58] Field of Search ..... 29/527.6, 148.4 C, 149.5 PM, 29/149.55; 427/135, 259, 329; 118/428, 500; 308/219, 235, 241

[56] References Cited

U.S. PATENT DOCUMENTS

| | | | |
|---|---|---|---|
| 1,290,202 | 1/1919 | Horan | 118/500 |
| 1,956,462 | 4/1934 | Knuth | 29/527.6 |
| 2,113,074 | 4/1938 | Bate | 29/527.6 |
| 3,383,250 | 5/1968 | Pierson et al. | 427/329 |
| 3,608,170 | 9/1971 | Larson et al. | 29/149.5 PM |
| 4,027,055 | 5/1977 | Schneble | 427/259 |

*Primary Examiner*—Michael J. Keenan

*Attorney, Agent, or Firm*—Browdy and Neimark

[57] ABSTRACT

The invention provides a method of, and apparatus for, producing a layer of antifriction metal on a metallic surface. The method involves using a die having a recess surrounded by a thin rim; the recess is filled with molten antifriction metal which is allowed to solidify, and thereafter the structure obtained is machined to remove unwanted parts of the die.

6 Claims, 6 Drawing Figures

COATING WITH ANTIFRICTION METAL

This invention relates to the formation of a layer of antifriction metal or whitemetal alloy on a metallic surface and, more particularly but not exclusively, is concerned with a method of fabricating a thrust pad.

Hitherto, thrust pads have been produced from a cylindrical annulus of backing material, generally of steel, gunmetal or bronze, which has been surface-treated so as to increase the coherence between the backing material and the antifriction metal, and has then been placed between inner and outer rings which serve to provide walls so that a quantity of molten antifriction metal may be poured onto the surface of the cylindrical annulus and may be contained between the walls constituted by the inner and outer rings. Thereafter, the coated cylindrical annulus is cut into a plurality of sectors each of which is then machined in order to produce a thrust pad. It is important to achieve a metallurgical bond between the backing material and the antifriction coating so that the former is able to support the latter, and so that heat generated at the surface of the antifriction coating during operation of the thrust pad is more readily dissipated. The cooling conditions applied to the cylindrical annulus to solidify the antifriction metal are critical in determining the nature of the bond between the backing material and the antifriction metal. To achieve satisfactory conditions, both the internal and external rings which hold the cylindrical annulus have to be carefully preheated. Difficulties may be experienced due to differential expansion of the internal and external rings. The direct cooling of the cylindrical annulus to solidify the antifriction metal should take place from behind the backing material for the best results. Once the antifriction metal has solidified, individual thrust pads must be cut from the annulus. The machining operations required to do this may weaken the bond between the backing material and the antifriction metal or even sever it.

It is an object of the present invention to provide a method of producing a layer of antifriction metal on a metallic surface which method obviates or alleviates the disadvantages described above.

According to one aspect of the present invention, there is provided a method of producing a layer of antifriction metal on a metallic surface using a die having a recess surrounded by a thin rim, which comprises preparing, if necessary, the surface(s) which is or are to receive the antifriction metal; filling the recess in the die with molten antifriction metal; allowing the antifriction metal to solidify; and thereafter machining the structure thus obtained to remove unwanted parts of the die.

The die is formed from a material which has a melting point above that of the antifriction metal. A copper based alloy is particularly suitable. The die may be a precision casting, such as may be produced by an investment casting technique. Any identification markings can be formed during the casting of the die.

Surface preparation prior to immersion in the molten antifriction metal is generally necessary. Grease, oxide and other contaminants must be removed from the surfaces to be coated in order to secure a sound metallurgical bond with the antifriction metal. Cohesion between a copper-based die material and an antifriction metal can be improved if the die is first tinned. A preferred surface preparation technique consists of the following steps:

(1) Degreasing the surfaces of the die;

(2) Heating the degreased die to a temperature of from 50° to 100° C;

(3) Applying a stopping-off coating to those surfaces of the die which are not to be coated with tin and antifriction metal;

(4) Applying a thin layer of flux to the surface of the die recess;

(5) Suspending the fluxed die above a tin bath in order to preheat the flux; and (6) Immersing the die in the tin bath so as to produce a layer of tin on the fluxed surfaces. It is preferred to withdraw the die from the tin bath after about 30 seconds and to wipe the tinned surfaces with a fluxed brush so as to ensure that each of the surfaces of the recess of the die is evenly coated with tin. The die may then be re-immersed in the tin bath for a further period of about 30 seconds. Thereafter, the die is withdrawn from the tin bath and any excess tin may be removed from the surface of the die by means of a brush. The tinned die may then be immediately filled with molten antifriction metal. This is advantageously done by immersing the die in a vat containing molten antifriction metal. By raising the die evenly from the vat of molten antifriction metal, the recess in the die is filled to the top of each rim. Thereafter the molten antifriction metal may be forcibly cooled, for example by placing the die on a water table or by forced air cooling. Once solidification is complete, the resultant structure may be totally submerged in a water bath to effect rapid cooling. Thereafter, the structure may be treated to remove any stopping off compound (e.g. by shot blasting) after which it is machined to remove unwanted parts of the die, generally the rims thereof. This may be done, for example, by milling the surface of the antifriction metal to remove excess thickness of antifriction metal and some of the rim of the die, followed by profile machining to remove the remainder of the rim. Stopping-off coating may be removed after the machining steps instead of before, if desired.

In order to produce a thrust pad, the antifriction metal coating technique described above is carried out, the initial die having the overall shape of the desired thrust pad. This may take the form of a sector of a cylindrical annulus provided with a dovetail connection on its base. After the antifriction metal coating has solidified, the die may be machined as described above in order to remove the rim from the thrust pad followed by machining of the antifriction metal surface to the desired finish. The pad may be subjected to conventional surface finishing techniques, for example an initial deburring, followed by surface grinding and a final deburring.

Advantageously, a plurality of dies may be subjected to the various treatment steps simultaneously. To this effect, they may be placed in a fixture as shown in FIG. 1 of the accompanying drawings. Some or all of the treatment steps may be automated.

The method of this invention may be used to provide a surface coating of any of the usual antifriction metals. These are often termed "whitemetal", and can be tin, lead or antimony based alloys; they generally comprise several of the elements tin, lead, antimony, copper, zinc, arsenic and cadmium. Certain less common antifriction metals may also contain nickel and iron. Typical alloying formulae (in parts by weight) for tin and lead based alloys are as follows:

| Tin Based Whitemetal | Lead Based Whitemetal |
|---|---|
| 78–92 Tin | 4.5–13 Tin |
| 4–10 Antimony | 12–17 Antimony |
| 0.1–5 Lead | 0.1–1 Copper |
| 2.5–8 Copper | 0.1–1.5 Arsenic |
| 0.1–5 Cadmium | Balance: lead |

According to another aspect of the present invention, there is provided apparatus which is adapted to receive a plurality of dies each having a metallic upper surface in which there is a recess surrounded by a thin rim and having a wedge-shaped lower portion, and which is for use in producing a layer of anti-friction metal within the recesses of the dies, which apparatus comprises an annular table having an annular channel formed in the upper surface thereof, wherein (a) the annular channel is generally wedge-shaped with upwardly coverging side walls; (b) a plurality of slots are formed in the bottom of the annular channel to permit communication from beneath the annular table to the upper surface thereof; and (c) the outer rim of the annular table (which defines the outer side wall of the annular channel) is recessed in one or more places to provide at least one keyway whereby the said dies may be introduced into the annular channel.

For a better understanding of the invention, and to show how the same may be carried into effect, reference will now be made, by way of example, to the accompanying drawings, in which.

Figure 1:
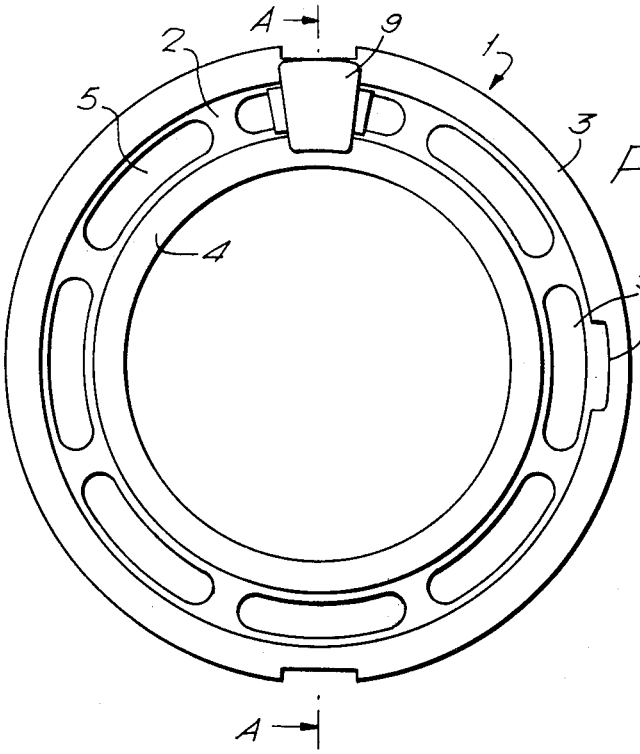
FIG. 1 is a plan view of apparatus in accordance with the invention.
Figure 2:
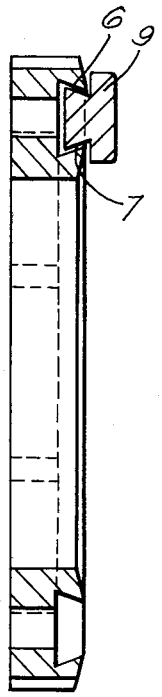
FIG. 2 is a cross-sectional view along the line A—A of FIG. 1.

Referring to FIGS. 1 and 2 of the drawings, the apparatus of this invention comprises an annular table 1 which is provided with an annular channel 2 located between an outer rim 3 and an inner rim 4. Slots 5 extend through the annular table from the bottom of the annular channel 2 and permit communication from the underside of the annular table to the upper surface thereof. As can be seen from FIG. 1*b*, the annular channel 2 is generally wedge-shaped with upwardly converging side walls 6 and 7. The outer rim 3 of the annular table includes a recess 8 which provides a keyway for the introduction into the annular channel 2 of a plurality of dies such as that illustrated at 9. As can be seen from FIGS. 3 and 4; each die comprises a lower, wedge-shaped portion 10 attached to the main body portion 11 of the die. A thin rim 12 extends all around a recess 13 on the upper surface of the main body portion of the die. A raised ridge 14 is provided on the lower surface of the wedge-shaped portion 10 of the die.

Figure 5:
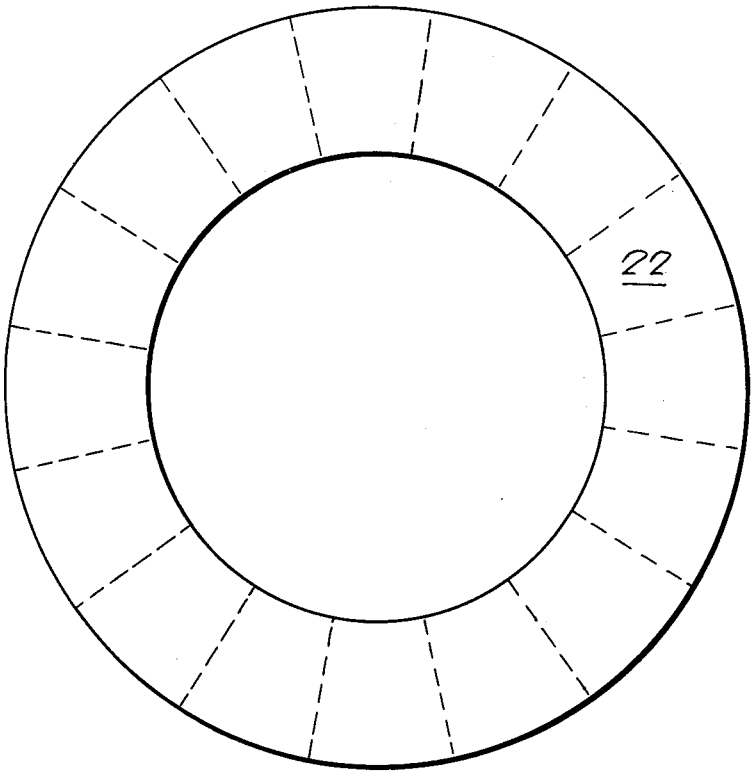
FIG. 5 is a plan view of apparatus used for a conventional method of producing an antifriction metal coating on a backing material.
Figure 6:
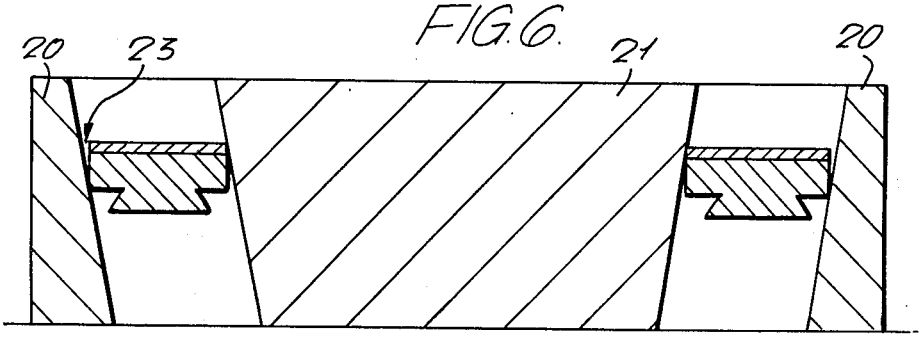
FIG. 6 is a vertical cross-sectional view of FIG. 5.

FIG. 5 shows a cylindrical annulus of backing material which is used in a conventional technique for producing thrust pads. The cylindrical annulus is treated in an apparatus as shown generally in FIG. 6. This apparatus comprises an outer ring 20 and an inner ring 21 between which the cylindrical annulus 22 is treated. The inner surface of the outer ring 20 and the outer surface of the inner ring 21 are tapered so that cylindrical annuli 22 of different dimensions may be contained therebetween for treatment. Before molten antifriction metal can be poured onto the cylindrical annulus 22, it is necessary to seal any gaps such as that indicated at 23 between the cylindrical annulus 22 and the outer ring 20.

The invention will be illustrated by the following Example.

EXAMPLE

Figure 3:
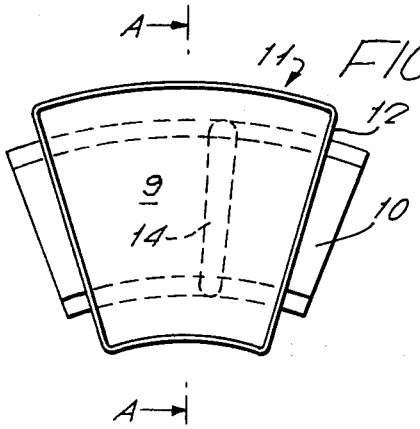
FIG. 3 is a plan view through a die for use in the apparatus of FIG. 1.
Figure 4:
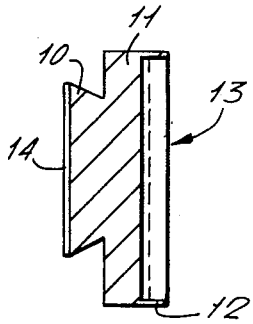
FIG. 4 is a diagrammatic sectional view along the line A—A of FIG. 3.

A die having the shape shown in FIG. 3 of the accompanying drawings was formed by an investment casting technique. The surfaces of the die were degreased after which the die was heated to a temperature of about 100° C. All the surfaces of the die except those defining the recess were then coated with a stopping-off coating in a conventional manner. A plurality of dies were then placed in an annular table 1 as shown in FIG. 1, and a thin layer of flux was applied to the surfaces of the recesses in each of the dies. The annular table containing the dies was then suspended above a bath of molten tin close to the surface thereof for a period of from 2 to 3 minutes or until the coating of flux on the die surfaces reached boiling point. The annular table with the dies therein was then lowered slowly into the bath of molten tin (at 260° C.) until it was completely immersed. 30 seconds later, it was withdrawn, the tinned areas of the dies were wiped with a fluxed brush and the annular table and dies were then re-immersed for a further 30 seconds. Upon final withdrawal of the annular table and dies from the tin bath, the surfaces of the recesses in the dies were brushed and were checked in order to ensure that a continuous tin coating had been formed on the recess surfaces of each die. The annular table containing the tinned dies was then slowly lowered into a vat of whitemetal at a temperature of 370° to 410° C. The annular table raised gently to ensure that each die was filled completely with molten whitemetal. The filled dies were then transferred to a water table in order to effect solidification of the molten whitemetal. Before water was brought into contact with the dies, the pool of whitemetal in each die was agitated mechanically to remove any trapped air. The water level was then raised until it reached the pad dove tail 10 (see FIG. 4), this being sufficient to effect complete solidification of the molten metal. Thereafter, the thrust pads were submerged in a water bath after which they were shot blasted to remove the stopping-off coating. The thrust pads were then profile machined in order to remove the rim of the die from the pad and were then subjected to milling to produce the desired thickness of whitemetal. The edges of the thrust pads were then deburred by means of an abrasive belt. An ultrasonic check was then carried out on the die base/whitemetal bond. The whitemetal surface and pivot 14 of the thrust pad were then ground, followed by a deburring step. Finally, the thrust pads were given a preliminary inspection followed by lapping and a final inspection to ensure smooth surfaces and accurate dimensions.

By employing the method and apparatus of this invention, the difficulties associated with the formation of a dam of molten metal between the inner and outer rings of the conventional apparatus shown in FIG. 5 are avoided. In addition, temperature control of the various process stages is simplified.

I claim:

1. A method of manufacturing a thrust pad, the method comprising:

casting a metallic thrust pad base, the base having a surface for receiving a molten antifriction metal, the periphery of the surface being formed with a rim which completely surrounds the surface so as to form a recess to retain the molten antifriction metal on the surface;

filling the recess with molten antifriction metal to form a layer of antifriction metal on said surface;

causing the antifriction metal to solidify; and machining the thrust pad base and the layer of antifriction metal attached thereto to remove those parts which are unwanted in the finished thrust pad.

2. A method according to claim 1, wherein the recess is filled with molten antifriction metal which is to be solidified by immersing the thrust pad base in a bath of molten antifriction metal.

3. A method according to claim 1, wherein said surface of the thrust pad base which is to receive the antifriction metal is tinned before it comes into contact with the antifriction metal by immersing the thrust pad base in a path of molten tin, those surfaces of the base which are not to receive the antifriction metal being protected by a stopping-off coating.

4. A method of manufacturing thrust pads, the method comprising:

casting a plurality of similar metallic thrust pad bases, each base having a surface for receiving a molten antifriction metal, the periphery of the surface being formed with a rim which completely surrounds the surface so as to form a recess to retain the molten antifriction metal on the surface;

arranging the bases in a channel formed in a table, the channel being annular and generally wedge-shaped in cross-section with upwardly converging side walls and a plurality of slots being formed through the bottom of the channel to permit communication from beneath the table to the upper surface thereof, which table is formed with an outer rim which defines an outer side wall of the channel and which is recessed in one or more places to provide at least one keyway whereby the bases may be introduced into the channel;

filling the recess of each base with molten antifriction metal to form a layer of antifriction metal on said surface;

causing the antifriction metal to solidify;

removing the bases from the channel; and machining each base and the layer of antifriction metal attached thereto to remove those parts which are unwanted in the finished thrust pad.

5. A method according to claim 4, wherein the recess in each base is filled with molten antifriction metal which is to be solidified by immersing the table and the bases in a bath of molten antifriction metal.

6. A method according to claim 4, wherein said surface of each base which is to receive the antifriction metal is tinned after the bases have been arranged in the channel and before the surfaces come into contact with the antifriction metal by immersing the table and the bases in a bath of molten tin, those surfaces of the bases which are not to receive the antifriction metal being protected by a stopping-off coating.

* * * * *